United States Patent [19]

Sinn

[11] Patent Number: 4,904,849

[45] Date of Patent: Feb. 27, 1990

[54] SELF-CLEANING OVEN TEMPERATURE CONTROL WITH ADAPTIVE CLEAN MODE RECALIBRATION

[75] Inventor: Richard E. Sinn, Harrison Township, Bartholomew County, Ind.

[73] Assignee: Whirlpool Corporation, Benton Harbor, Mich.

[21] Appl. No.: 267,792

[22] Filed: Nov. 7, 1988

[51] Int. Cl.[4] ..... F24C 7/08; F24C 14/02

[52] U.S. Cl. ..... 219/413; 219/497

[58] Field of Search ..... 219/412, 413, 501, 497, 219/391, 392, 395–398

[56] References Cited

U.S. PATENT DOCUMENTS 4,369,352 1/1983 Bowles ..... 219/413

4,761,539 8/1988 Carmean ..... 219/413

*Primary Examiner*—Teresa J. Walberg

*Attorney, Agent, or Firm*—Mason, Kolehmainen, Rathburn & Wyss

[57] ABSTRACT

A self-cleaning oven includes an oven temperature control system that adjusts a nominal clean temperature by a fixed amount in response to any recalibration of the oven's bake temperature. The bake temperatures are recalibrated by selecting one of a plurality of offset values and the polarity of the offset value. The control system in the clean mode is responsive to any recalibration of the bake temperatures to increase the nominal clean temperature by a fixed amount if the polarity of the bake temperature offset is positive and to decrease the nominal clean temperature by a fixed amount if the polarity of the bake temperature offset is negative.

10 Claims, 1 Drawing Sheet

SELF-CLEANING OVEN TEMPERATURE CONTROL WITH ADAPTIVE CLEAN MODE RECALIBRATION

BACKGROUND OF THE INVENTION

1. Field of the Invention

The present invention relates to temperature control systems and methods and, more particularly, to a new and improved self-cleaning oven temperature control system and method.

2. Description of the Prior Art

Self-cleaning ovens and temperature controls therefor are old and well-known in the prior art as exemplified by U.S. Pat. Nos. 3,121,158; 3,122,626; 3,310,654; 3,327,094; 3,353,004; 3,569,670; 3,648,012; 3,738,174; 3,924,101; 4,166,268; 4,214,224; and 4,369,352. Conventionally, the bake temperature controls for many prior art self-cleaning ovens are capable of being recalibrated in service to compensate for oven components that deviate from design specifications or to accommodate individual user preferences. See, for example, the above-identified '670 patent and the '101 patent and the '352 patent.

Some prior art temperature control systems for self-cleaning ovens are designed to maintain a constant clean temperature even though the bake temperatures have been recalibrated and offset by a predetermined amount from nominal values. If the clean temperature remains constant when the oven has been recalibrated to provide higher bake temperatures in order to offset a negative drift in temperature sensing hardware, the clean temperature may be too low to provide an effective self-cleaning operation. Recalibration of the bake temperatures in other prior art systems necessarily affects the clean temperature wherein a change in the bake temperatures causes an equal or proportionate change in the clean temperature. However, these prior art systems can cause the clean temperature to be recalibrated to an unsafe, high level.

SUMMARY OF THE INVENTION

In accordance with the present invention, the disadvantages of prior art self-cleaning oven temperature control systems has been overcome. The self-cleaning oven temperature control system of the present invention automatically adjusts the clean temperature a fixed amount when any adjustment to the bake temperatures has been made to recalibrate the oven.

More particularly, the self-cleaning oven temperature control system of the present invention includes a first means for selecting one of a plurality of bake temperature offset values to recalibrate the bake temperatures. A second means is provided for setting the polarity of a selected bake temperature offset value. A microprocessor control is responsive to the selected bake temperature offset value and its polarity to operate the oven at one of a plurality of bake temperature recalibration levels. In the clean mode, however, the microprocessor control is responsive only to the polarity of the selected bake temperature offset to operate the oven at a single positively recalibrated clean temperature in response to a positive polarity setting and to operate the oven at a single negatively recalibrated clean temperature in response to a negative polarity setting wherein the positively and negatively recalibrated clean temperatures differ from the nominal clean temperature of the oven by the same fixed amount.

Because the clean temperature is adjusted a fixed amount when any adjustment is made to the bake temperatures, the system of the present invention ensures that the clean temperature is adjusted enough to compensate for drifts in the oven's components without the danger of producing extreme oven surface temperatures.

These and other objects, advantages and novel features of the present invention, as well as details of an illustrated embodiment thereof, will be more fully understood from the following description and the drawing.

DESCRIPTION OF THE PREFERRED EMBODIMENT

Figure 1:
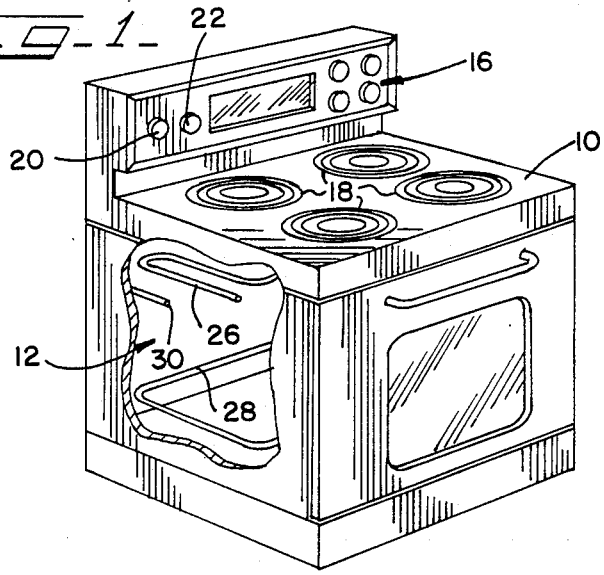
FIG. 1 illustrates a self-cleaning electric range having an oven adapted to be controlled by an oven temperature control system and method constructed in accordance with the principles of the present invention.
Figure 2:
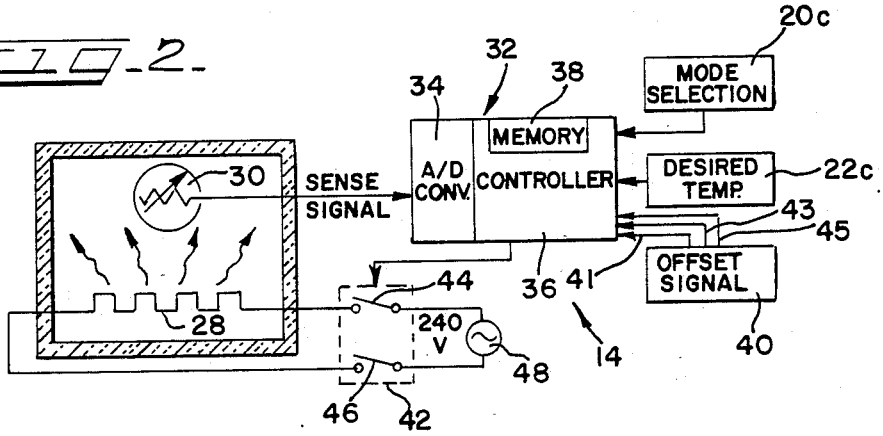
FIG. 2 is a schematic view of a digital electronic microprocessor based oven temperature control system constructed in accordance with the principles of the present invention.
Figure 3:
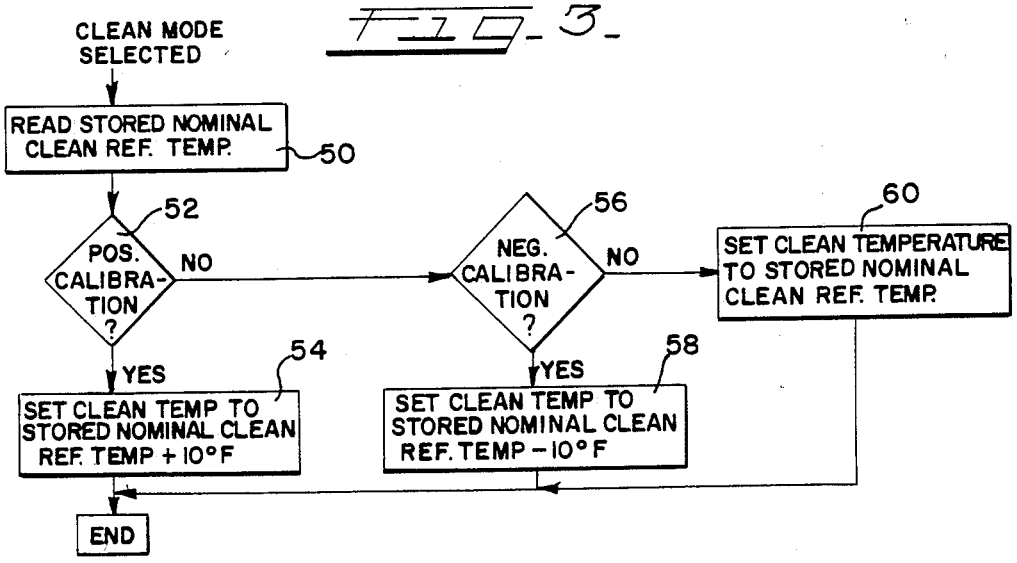
FIG. 3 is a flow chart illustrating the operation of the microprocessor based oven temperature control system of FIG. 2 in the clean mode.

Referring to the drawing and specifically to FIGS. 1–3 thereof, an electric range 10 is illustrated having a self-cleaning oven 12 adapted to be controlled by a new and improved digital electronic microprocessor based control system 14 and method in accordance with the principles of the present invention. The range 10 includes a plurality of four control knobs 16 for respectively controlling a plurality of four conventional electric burners 18. In addition, the range 10 includes a control knob 20 for controlling the mode of operation of the oven 12, for example, the OFF mode, the BAKE mode, the BROIL mode and the CLEAN mode of operation. In addition, the range 10 includes a control knob 22 to enable the desired oven temperature to be selected by the user of the oven 12. Disposed within a cavity 24 of the oven 12 are a conventional broiling element 26 and a conventional heating element 28. Finally, suitably positioned within the cavity 24 of the oven 12 is a conventional temperature sensor 30, for example, a standard oven temperature sensing probe.

The digital electronic control system 14 includes a conventional microprocessor 32 capable of being suitably programmed to effect the desired control of the range 10 and, more particularly with respect to the present invention, the oven 12. Conventionally, the microprocessor 32 includes an analog-to-digital (A/D) converter 34 for receiving analog voltage input signals from, for example, the temperature sensor 30 and for providing digital output pulses or signals to a controller section 36 within the microprocessor 32. Conventionally, the microprocessor 32 has a memory 38, including a read only memory or ROM, for retaining the programmed instructions for operating the control system 14 including desired oven temperature control algorithm for controlling the temperature of the oven 12.

The control system 14 further includes an offset signal circuit 40 for providing a desired temperature offset signal to the controller 36 of the microprocessor 32 during a recalibration operation. For example, the offset signal circuit 40 conventionally could take the form of three switches which may be selectively set to provide three digital input signals coupled to the controller 36 on respective lines 41, 43 and 45. The three digital input signals may be used to enable a recalibration of the bake temperature in three 7° F. steps for a maximum bake temperature offset during recalibration of ±21° F. Specifically, a first one of the three digital input signals may be used to indicate the polarity of the bake temperature offset, the value of which is indicated by one or both of the other two digital input signals. For example, a low input signal on line 41 may indicate a negative polarity bake temperature offset whereas a high input signal on line 41 may indicate a positive polarity bake temperature offset. A second digital input signal on line 42 may be used to indicate an offset of the bake temperatures of 7° F. when, for example, that input signal is high; whereas, a third input signal on line 45 may be used to indicate a desired bake temperature offset of 14° F. when, for example, that input signal is high.

The control system 14 also includes a power switching relay 42 that includes a pair of relay contacts 44 and 46 for switching power to the heating element 28 from a constant voltage (e.g., 240 volts) source 48 of alternating current electric power, under the control of the controller 36. For simplification, only the heating element 28 and the power relay 42 therefor have been illustrated in FIG. 2 in the control system 14. In an actual commercial embodiment, however, the broiling element 26 would obviously also be part of the control system 14 along with its own power switching relay to interconnect the broiling element 26 to the source 48 under the control of the controller 36. The broiling element 26 would obviously be used in conjunction with the heating element 28 during the BROIL mode of operation of the oven 12 and may also be used during the CLEAN and BAKE modes of operation of the oven 12 to provide sufficient heat to the oven 12 under the control of the controller 36.

During the BAKE mode of operation, the heating element 28 is energized by the source 48 through the relay 42 under the control of the controller 36 to heat and raise the temperature of items to be cooked within the oven cavity 24 of the oven 12. The sensor 30, typically disposed within the oven cavity 24, is used to provide an output analog voltage signal as an input to the A/D converter 34. That analog input signal is converted to a digital output signal and is supplied to the memory 38 and the controller 36 for controlling the ON-OFF state of the relay 42 and, thereby, the energization of the heating element 28.

As is conventional, a user of the range 10 selects by means of the control knob 20 the desired mode of operation of the oven 12, which mode selection is provided as an input signal to the microprocessor 32 by a conventional mode selection circuit 20*c*. If the BAKE mode of operation of the oven 12 has been selected, the user also selects a desired bake temperature by means of the control knob 22 which desired temperature is also provided as an input signal to the microprocessor 32 by a conventional desired temperature circuit 22*c*. The microprocessor 32 then, through the controller 36, controls the state of the power relay 42 to energize or deenergize the heating element 28 as a function of the actual oven temperature as sensed by the sensor 30 and of the desired temperature as provided by the desired temperature circuit 22*c*. The broiling element 26 may be similarly controlled to provide additional heat during the BAKE mode.

Occasionally, as a result of the desires of the user or a variation or degradation of the performance of one or more oven components, the bake temperatures of the oven 12 may require recalibration, particularly during a field service call. To recalibrate the bake temperatures, the selected bake temperature offset value signal(s) and the polarity signal are coupled from the offset signal circuit 40 to the microprocessor 32 for use each time a bake temperature subroutine of the oven temperature control algorithm is executed by the microprocessor 32. The temperature offset signals resulting from the recalibration of the bake temperatures are used to modify the actual value of either the user selected desired temperature or the sensed oven temperature.

Recalibration of the clean temperature occurs automatically in response to a recalibration of the bake temperature. Specifically, the microprocessor 32 is responsive to the presence of a polarity signal from the offset signal circuit 40 on line 41 to increase a nominal clean temperature by a fixed amount if the polarity signal indicates a positive offset and to decrease the nominal clean temperature by a fixed amount if the polarity signal indicates a negative offset. Thus, a bake temperature recalibration of any amount results in a single change in the clean temperature. The clean temperature is therefore adjusted enough to compensate for component drift without the danger of producing extreme oven surface temperatures.

More particularly, as shown in FIG. 3 for the clean temperature subroutine, the microprocessor 32 is responsive to the selection of the clean mode as signaled by the mode selection circuit 20*c* to read, at block 50, the nominal clean reference temperature stored in the read only memory formed in a portion of the memory 38. Thereafter, at block 52, the microprocessor 32 determines whether a signal indicating a positive polarity offset is coupled from the offset signal circuit 40 on line 41. If a positive polarity indicating signal is coupled to the microprocessor 32 as determined by block 52, the microprocessor at block 54 sets the clean temperature to the stored nominal clean reference temperature plus 10° F. If a signal indicating a negative polarity offset is coupled to the microprocessor 32 from the offset signal circuit 40 on line 41 as determined by the microprocessor 32 at block 56, the microprocessor at block 58 sets the clean temperature to the stored nominal clean reference temperature minus 10° F. If neither the positive polarity indicating signal nor the negative polarity indicating signal are coupled to the microprocessor 32 from the offset signal circuit 40 on line 41 as determined by the microprocessor 32 at blocks 52 and 56, the microprocessor 32 at block 60 sets the clean temperature to the nominal clean reference temperature stored in the read only memory of the microprocessor's memory 38.

Many modifications and variations of the present invention are possible in light of the above teachings. Thus, it is to be understood that, within the scope of the appended claims, the invention may be practiced otherwise than as described hereinabove.

What is claimed and desired to be secured by Letters Patent is:

1. A self-cleaning oven comprising:

an oven cavity adapted to receive items to be cooked by said oven;

heating means within said oven for raising the temperature of said oven cavity;

means for controlling said heating means in a bake mode of operation with nominal or recalibrated bake temperatures and in a clean mode of operation with a nominal or recalibrated clean temperature;

means for recalibrating the temperature at which said oven operates in said bake mode to temperatures greater than said nominal bake temperature for a positive recalibration and to temperatures less than said nominal bake temperatures for a negative recalibration; and means responsive to said bake temperature recalibration means for recalibrating the temperature at which said oven operates in said clean mode, said clean temperature recalibration means being responsive to any positive bake temperature recalibration to increase the clean temperature a fixed amount above said nominal clean temperature and being responsive to any negative bake temperature recalibration to decrease the clean temperature a fixed amount below said nominal clean temperature.

2. A self-cleaning oven as recited in claim 1 wherein said nominal clean temperature is increased by the same fixed amount as said nominal clean temperature is decreased.

3. A self-cleaning oven as recited in claim 1 wherein said fixed amount is approximately 10° F.

4. A self-cleaning oven comprising:

an oven cavity adapted to receive items to be cooked by said oven;

heating means within said oven for raising the temperature of said oven cavity;

means for selecting one of a plurality of bake temperature offset values to provide a signal representative thereof;

means for selecting the polarity of a selected bake temperature offset value to provide a signal representative thereof; and means for controlling the operation of said oven in a bake mode of operation and in a clean mode of operation, said control means being responsive to an offset signal and a polarity signal to operate said oven at one of a plurality of bake temperature recalibration levels and said control means being responsive to a positive polarity signal representing a positive offset value to operate said oven at a single positively recalibrated clean temperature and being responsive to a polarity signal representing a negative offset value to operate said oven at a single negatively recalibrated clean temperature.

5. A self-cleaning oven as recited in claim 4 wherein said control means includes a microprocessor for automatically controlling the operation of said oven in the bake mode and the clean mode.

6. A self-cleaning oven as recited in claim 5 wherein said control means includes a read only memory for storing a nominal clean temperature, said microprocessor in said clean mode being responsive to a polarity signal representing a positive offset value for operating said oven a fixed amount above said nominal clean temperature and being responsive to a polarity signal representing a negative offset value for operating said oven a fixed amount below said nominal clean temperature.

7. A self-cleaning oven as recited in claim 6 wherein said fixed amount above said nominal clean temperature is the same as the fixed amount below said nominal clean temperature.

8. A self-cleaning oven as recited in claim 7 wherein said fixed amount represents 10° F.

9. A method of controlling the operation of a self-cleaning oven having heating means for raising the temperature of the oven, control means for controlling the operation of the oven in a bake mode and a clean mode and a data storage memory comprising the steps of:

storing a nominal clean temperature in said data storage memory;

indicating the polarity of any bake mode temperature recalibration;

setting the temperature according to which said control means operates said oven at said nominal temperature plus a fixed amount in response to the indication of a positive polarity bake mode temperature recalibration; and setting the temperature according to which said control means operates said oven at said nominal temperature minus a fixed amount in response to the indication of a negative polarity bake mode temperature recalibration.

10. The method of controlling the operation of a self-cleaning oven as recited in claim 9 wherein the fixed amount added to said nominal temperature in response to a positive polarity bake mode temperature recalibration is the same as the fixed amount subtracted from said nominal temperature in response to a negative polarity bake mode temperature recalibration.

* * * * *